US008733390B2

(12) United States Patent
McKeague

(10) Patent No.: US 8,733,390 B2
(45) Date of Patent: May 27, 2014

(54) AUTOMATIC FLUSHING DEVICE FOR MUNICIPAL WATER SYSTEMS

(75) Inventor: Daniel G. McKeague, Kirkwood, MO (US)

(73) Assignee: John C. Kupferle Foundry Company, St. Louis, MO (US)

( * ) Notice: Subject to any disclaimer, the term of this patent is extended or adjusted under 35 U.S.C. 154(b) by 0 days.

(21) Appl. No.: 11/522,657

(22) Filed: Sep. 18, 2006

(65) Prior Publication Data

US 2007/0075162 A1 Apr. 5, 2007

Related U.S. Application Data

(60) Provisional application No. 60/717,704, filed on Sep. 17, 2005, provisional application No. 60/736,425, filed on Nov. 14, 2005.

(51) Int. Cl.

| | |
|---|---|
| ***E03B 9/02*** | (2006.01) |
| ***B05B 1/28*** | (2006.01) |
| ***B05B 15/02*** | (2006.01) |
| ***F23D 11/34*** | (2006.01) |
| ***F23D 14/50*** | (2006.01) |

(52) U.S. Cl.

USPC ..... 137/296; 137/299; 239/104; 239/106; 239/110; 239/504; 239/506

(58) Field of Classification Search

USPC ..... 239/110, 104, 201, 504, 506, 518, 542, 239/106; 285/110; 137/302, 625.22, 375, 137/272, 275, 276, 277, 286, 287, 290, 293, 137/294, 296, 295, 299; 210/136, 97, 104, 210/201, 137

See application file for complete search history.

(56) References Cited

U.S. PATENT DOCUMENTS

| | | | | | |
|---|---|---|---|---|---|
| 2,023,428 | A | * | 12/1935 | Liebhardt | 285/110 |
| 3,722,816 | A | * | 3/1973 | Stewart et al. | 239/17 |
| 4,165,532 | A | | 8/1979 | Kendall et al. | |
| 4,189,776 | A | | 2/1980 | Kendall | |
| 4,735,361 | A | * | 4/1988 | Wallace | 239/110 |
| 4,756,479 | A | * | 7/1988 | Lazenby, III | 239/110 |
| 4,799,142 | A | | 1/1989 | Waltzer et al. | |
| 5,201,338 | A | * | 4/1993 | McKeague | 137/238 |
| 5,628,456 | A | * | 5/1997 | Dupre | 239/14.2 |
| 5,797,417 | A | | 8/1998 | DeLattre et al. | |

(Continued)

OTHER PUBLICATIONS www.web.archive.org/web/20031206235155/hydro-guard.com/basic+unit.htm, The Hydro-Guard® Basic Unit, dated Dec. 6, 2003 (1 page).

(Continued)

*Primary Examiner* — Ryan Reis
(74) *Attorney, Agent, or Firm* — Polster, Lieder, Woodruff, & Lucchesi, L.C.

(57) ABSTRACT

A device for automatically flushing a dead-end of an underground municipal water distribution system includes an inlet for receiving pressurized water from the water distribution system, an outlet fluidly connected to the inlet conduit for discharging pressurized water from the inlet, and a control valve for controlling the flow of pressurized water between the inlet and the outlet. A housing surrounding the outlet redirects the water radially outwardly. An upper mounting plate locates the device within the housing. The upper mounting plate is mounted to an in-ground enclosure; releasing the upper mounting plate from the enclosure allows pulling the device from the underground water distribution system entirely from above.

25 Claims, 6 Drawing Sheets

(56) References Cited

U.S. PATENT DOCUMENTS

| | | | | |
|---|---|---|---|---|
| 5,921,270 | A | 7/1999 | McCarty | |
| 5,979,482 | A | 11/1999 | Scott | |
| 5,996,608 | A | 12/1999 | Hunter et al. | |
| 6,035,704 | A | 3/2000 | Newman | |
| 6,062,259 | A | 5/2000 | Poirier | |
| 6,095,429 | A * | 8/2000 | Killgrove et al. | 239/172 |
| 6,170,514 | B1 * | 1/2001 | Esmailzadeh | 137/238 |
| 6,216,792 | B1 * | 4/2001 | Miller | 169/46 |
| 6,263,903 | B1 * | 7/2001 | Sjoberg | 137/364 |
| 6,358,408 | B1 | 3/2002 | Newman | |
| 6,467,498 | B1 | 10/2002 | Esmailzadeh | |
| 6,568,416 | B2 * | 5/2003 | Tucker et al. | 137/14 |
| 6,659,368 | B2 * | 12/2003 | Capps | 239/310 |
| 6,820,635 | B1 | 11/2004 | McKeague | |
| 7,137,568 | B1 * | 11/2006 | LaCrosse | 239/1 |
| 7,143,779 | B2 * | 12/2006 | Parker | 137/375 |
| 7,228,868 | B2 * | 6/2007 | Kang | 137/301 |
| 7,314,057 | B2 * | 1/2008 | Parker | 137/296 |
| 2004/0079689 | A1 * | 4/2004 | Newman | 210/136 |
| 2004/0123992 | A1 * | 7/2004 | Davidson | 169/16 |
| 2004/0238028 | A1 | 12/2004 | Taylor et al. | |
| 2004/0238037 | A1 | 12/2004 | Taylor et al. | |
| 2004/0238458 | A1 | 12/2004 | Taylor et al. | |
| 2004/0252556 | A1 | 12/2004 | Taylor et al. | |
| 2005/0067015 | A1 * | 3/2005 | McKeague | 137/299 |
| 2005/0067833 | A1 * | 3/2005 | Ball | 285/148.23 |

OTHER PUBLICATIONS www.web.archive.org/web/20040106213355/hydro-guard.com/(H-G1-B)basic.JPG, dated Jan. 6, 2004 ("Typical Installation Hydro-Guard H-G1-B" drawing dated Sep. 10, 2003)(1 page).

Hydro-Guard Automatic Programmable Temporary Flushing System, dated Jan. 5, 2006 (2 pages).

"Product Information: ICV Valves," P/N 700327 (Hunter Industries Incorporated, Nov. 2003 "ICV Commercial Valves," P/N 700683 (Hunter Industries Incorporated, Apr. 2005.

"Product Information, Battery-Powered Controllers," P/N 700885 (Hunter Industries Incorporated, Jan. 2004 "Budget Pedestal Housing (BPH) Series," Channell Communications Corporation, Oct. 2002.

* cited by examiner

AUTOMATIC FLUSHING DEVICE FOR MUNICIPAL WATER SYSTEMS

CROSS-REFERENCE TO RELATED APPLICATIONS

This application is related to U.S. Provisional Patent Application No. 60/717,704, filed Sep. 17, 2005, and U.S. Provisional Patent Application No. 60/736,425, filed Nov. 14, 2005, from both of which priority is claimed, and the disclosures of which are hereby incorporated by reference.

STATEMENT REGARDING FEDERALLY SPONSORED RESEARCH

Not applicable.

BACKGROUND OF THE INVENTION

This invention relates to hydrants or valves attached to municipal water systems, and in particular to a device for simplifying the flushing of portions of water systems.

The need for periodically flushing portions of water systems, particularly dead-ends in the systems, has been recognized for many years, as shown for example in Lazenby III, U.S. Pat. No. 4,756,479. A summary of many of the problems requiring such flushing, as well as of the traditional solutions to those problems, is contained in my co-owned U.S. Pat. No. 5,201,338. More recently, such flushing operations have been automated, as described in McCarty, U.S. Pat. No. 5,921,270. The McCarty patent is owned by a company related to the assignee of the present invention. A similar approach is described in Newman, U.S. Pat. Nos. 6,035,704 and 6,358,408. Other approaches are shown in Poirer, U.S. Pat. No. 6,062,259, and Esmailzadeh, U.S. Pat. No. 6,467,498, and in Taylor et al, published applications US 20040252556, US 20040238458, US 20040238037, and US 20040238028.

Although the prior art systems have met with success, the complexity of the systems, the time and effort required to install and use them, the difficulties attendant to removing and servicing them, and their consequent expense have limited their use.

In accordance with another approach to providing automatic flushing, described in my co-owned U.S. Pat. No. 6,820,635, a portable device is installed externally to the outlet of an existing hydrant. This approach requires keeping the hydrant's manual valve open, and the device must be removed from the hydrant in freezing weather.

It is important to maintain water quality, including chlorine residuals, at dead ends of municipal water systems regardless of how the line is purged. If it is flushed infrequently, a large amount of water must be flushed from the system; if it is flushed frequently, then a much smaller amount of water need be expelled.

BRIEF SUMMARY OF THE INVENTION

Briefly stated, one aspect of the present invention provides a device and method for automatically flushing portions of a municipal water system by providing a housing for an upper outlet portion of the device, the housing including a diffuser having peripheral openings for expelling water from the device laterally near ground level and a cover extending above the diffuser.

In accordance with another aspect of the invention, a device for automatically flushing a dead-end of an underground municipal water distribution system includes an inlet for receiving pressurized water from the water distribution system, an outlet fluidly connected to the inlet conduit for discharging pressurized water from the inlet, and a control valve for controlling the flow of pressurized water between the inlet and the outlet. A first mount positions the device and holds it in place. The first mount is releasably mounted to an in-ground enclosure; releasing the upper mount from the enclosure allows pulling the device from the underground water distribution system entirely from above. A push-together connector on the lower, inlet, end of the device structure fits an outlet fitting in an underground municipal water system, to allow the device to be removed from the municipal water system entirely from above ground.

In an illustrative embodiment, the device includes a second mount attached to the in-ground enclosure, and the first mount is releasably attached to the second mount. The second mount allows the inlet and the valve to be pulled upward through the in-ground enclosure. The first mount is preferably removed with the device. The first mount is conveniently a plate which acts as a baffle for water flowing through the device.

Other aspects of the invention will be apparent to those skilled in the art in light of the following description of illustrative embodiments of the invention. It will be understood by those skilled in the art that many of the features and components of the foregoing patents and applications may be utilized in embodiments of the present invention. All the foregoing patents and applications are hereby incorporated by reference.

BRIEF DESCRIPTION OF THE SEVERAL VIEWS OF THE DRAWINGS

In the accompanying drawings which form part of the specification.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
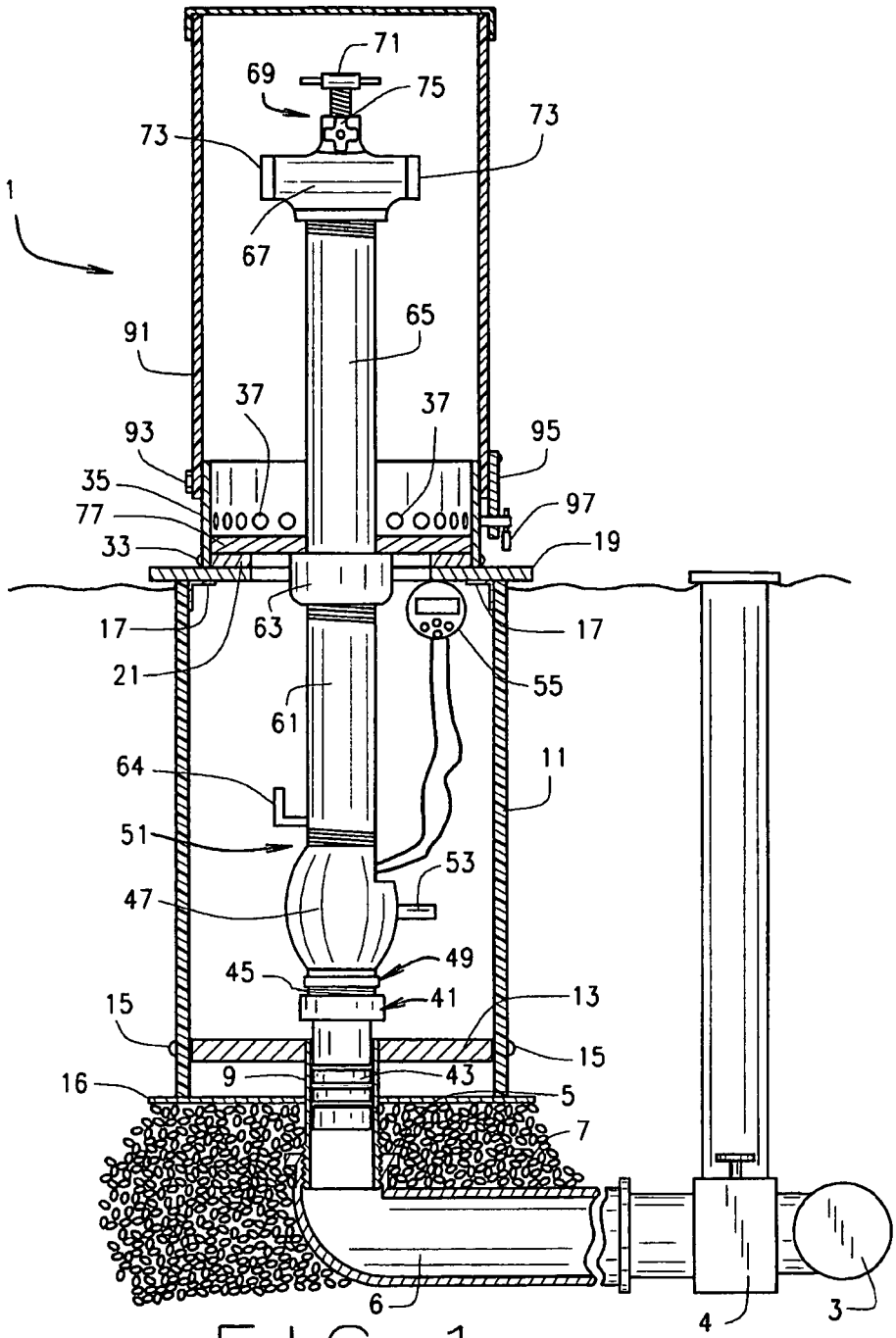
FIG. 1 is a diagrammatic view in cross section showing a flushing hydrant in accordance with one embodiment of the present invention.

As shown in FIG. 1, an illustrative embodiment of the invention includes an automatic flushing device 1 attached to an underground water main 3 through a shut-off valve 4 and an elbow 6. The elbow 6 has an upwardly opening 2" fitting 5, having female threads. The main is set in a bed of gravel or dirt 7.

Figure 4:
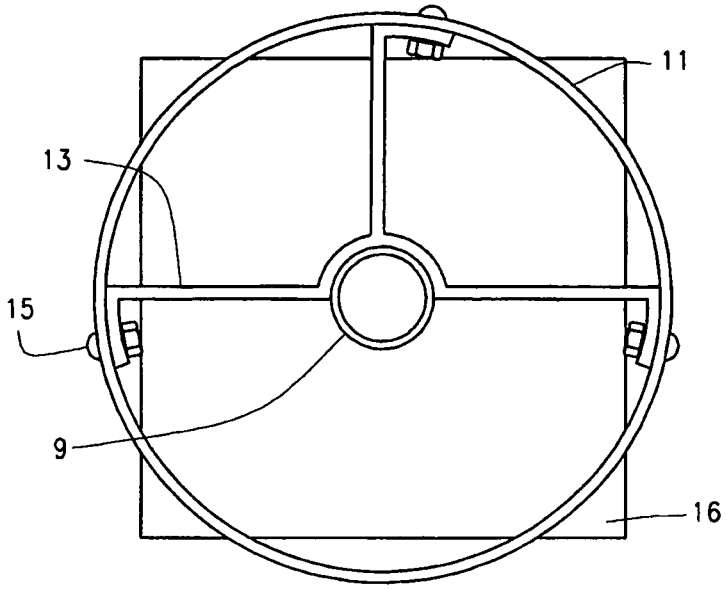
FIG. 4 is a top plan view showing a bracket mounted in a lower casing portion of the device of FIG. 1, for positioning the casing with respect to an inlet adapter.
Figure 5:
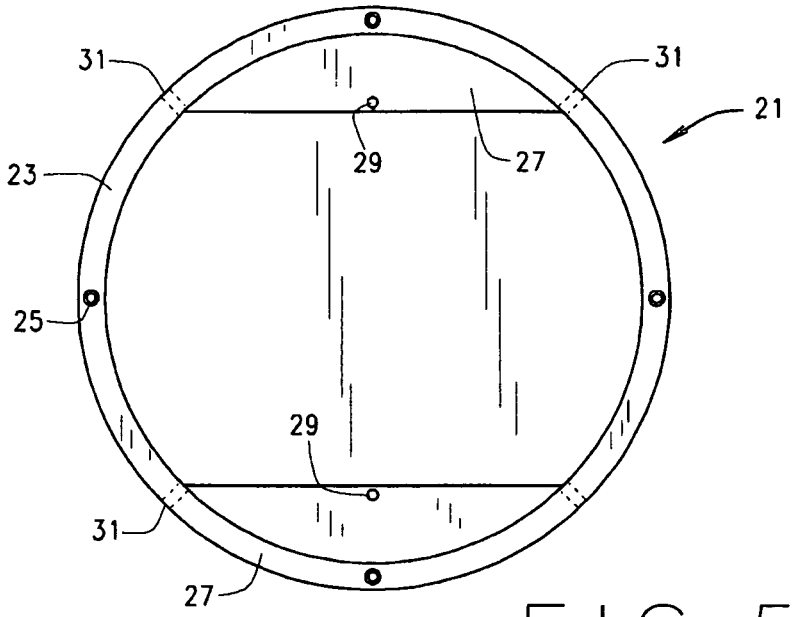
FIG. 5 is a top plan view of a lower mounting plate of the device of FIG. 1.

An inlet adapter 9 of the flushing device 1 is threaded into the fitting 5. The inner bore of the upper portion of the adapter 9 is machined to close tolerance, to accept a mating piece as described hereinafter. As shown in FIG. 4, the inlet adapter 9 is held to a casing 11 by a bracket 13, which holds the adapter 9 frictionally. The bracket 13 is mounted to the casing by bolts 15. The casing 11 is made of heavy-gauge polyvinyl chloride (PVC) and has a diameter of about twelve inches. The casing 11 has a height proportioned to the depth of bury of the main 3, so that the top of the casing 11 is preferably flush with, or somewhat above, ground level. A plastic debris shield 16 may be adhered to the bottom of the casing 11 for ease of installation of the device. The debris shield 16 permits water to drain through or around it, but tends to keep rocks and dirt out of the casing 11. Brackets 17 at the upper end of the casing 11 mount a splash guard 19 to the top of the casing 11. The splash guard 19 is illustratively a twenty-four-inch square of 0.75" thick PVC, with a central ten-inch diameter circular opening. Mounted to the top of the splash guard 19 is a lower mounting plate 21, shown in more detail in FIG. 5. The lower mounting plate 21 is an aluminum casting. Plate 21 has an outer rim 23 through which screws 25 attach the lower plate 21 to the splash guard 19, and a pair of segments or webs 27 defined by parallel chords and spaced apart about 6.5". The webs 27 have tapped holes 29. Four radial tapped holes 31 in the rim 23 of the lower plate 21, displaced 45° from the holes for screws 25, accommodate screws 33 which mount a cylindrical water diffuser 35. The diffuser 35 is formed of PVC and has an inner diameter of about 10.2" and a height of about seven inches. About 1.5" from the lower edge of the diffuser 35 is a circumferential ring of outlet openings 37, each about one inch in diameter and spaced apart about one-half inch.

The parts of the device 1 described thus far are all intended to be mounted permanently in a hole dug to the depth of the fitting 5 on the main 3. The inlet adapter 9 is threaded into the fitting 5 on the main, and the lower end of the casing 11 is lowered to rest on the gravel or dirt 7, with the bracket 13 holding the inlet adapter 9 frictionally. Once buried, this part of the device 1 is stable.

The remaining parts of the device 1 are designed to be easily removed for servicing.

An o-ring coupler 41 includes a plug part 43. The plug part 43 includes a plurality of circumferential grooves carrying spaced-apart o-rings. The plug part 43 is sized to be pushed into inlet adapter 9 and form a water-tight fit with it, regardless of how far into the inlet adapter 9 the plug part 43 is pushed, so long as at least the first o-ring engages the inner wall of the inlet adapter 9. At its upper end, the coupler 41 is threaded as shown at 45 to fit a 2" electrically operated valve 47.

The valve 47 is illustratively a 2" plastic irrigation valve sold by Hunter Industries Incorporated as its model ICV. This valve is described in "Product Information: ICV Valves," P/N 700327 (Hunter Industries Incorporated, November 2003) and ICV Commercial Valves brochure P/N 700683. The valve 47 is a diaphragm valve in which line pressure exerted over the diaphragm holds the valve closed, and opening of a bleed port by a solenoid relieves pressure in the diaphragm chamber and causes the valve to open. The construction and operation of such valves are well known in the art and are described for example in Hunter et al., U.S. Pat. No. 5,996,608 and Scott, U.S. Pat. No. 5,979,482. The valve 47 is illustratively oriented with its inlet 49 and its outlet 51 directed vertically. The valve 47 is manually adjustable by means of manual adjuster 53 to permit flow rates from a trickle (0.10 gallons per minute) to as high as forty gallons per minute. In the present embodiment, however, the flow rate is set high and the valve 47 is not normally adjusted.

The solenoid of valve 47 is controlled by a Hunter SVC battery-operated valve controller 55. The controller 55 is described in Product Information, Battery-Powered Controllers, P/N 700885 (Hunter Industries Incorporated, January 2004). The controller 55 is battery powered and includes manually operable buttons for setting the operating cycle, the run time, and the beginning of the run time, and can utilize multiple programs. The controller 55 may be accessed for programming as described hereinafter.

A lower outlet pipe 61 is threaded into the outlet of the valve 47. The lower outlet pipe 61 is sized to terminate at or near ground level. A threaded pipe coupling 63 is provided at its upper end. A standard ball check valve 64 is threaded into the side of lower outlet pipe 61 to provide drainage of the system above the check valve whenever the valve 47 is closed. An upper outlet pipe 65 is threaded into the coupling 63. To the upper end of the upper outlet pipe 65 is mounted a cross fitting 67. The upper end of the cross fitting carries a flow adjuster 69 having a manual handle 71 to adjust the flow through horizontal arms 73 of the cross fitting. When the desired flow is established, set screw 75 is tightened to prevent accidental movement of the adjuster 69.

Between the pipe coupling 63 and the cross fitting 67, a machined stainless steel upper plate 77 is slidably mounted on the upper outlet pipe 65. The inner opening 78 of the upper plate 77 is closely sized to stabilize the upper outlet pipe 65 and to allow the plate 77 to abut the coupling 63. The outer diameter of the upper plate 77 is slightly less than the inner diameter of the cylindrical diffuser 35, to permit the upper plate 77 to slide smoothly within it.

Figure 3:
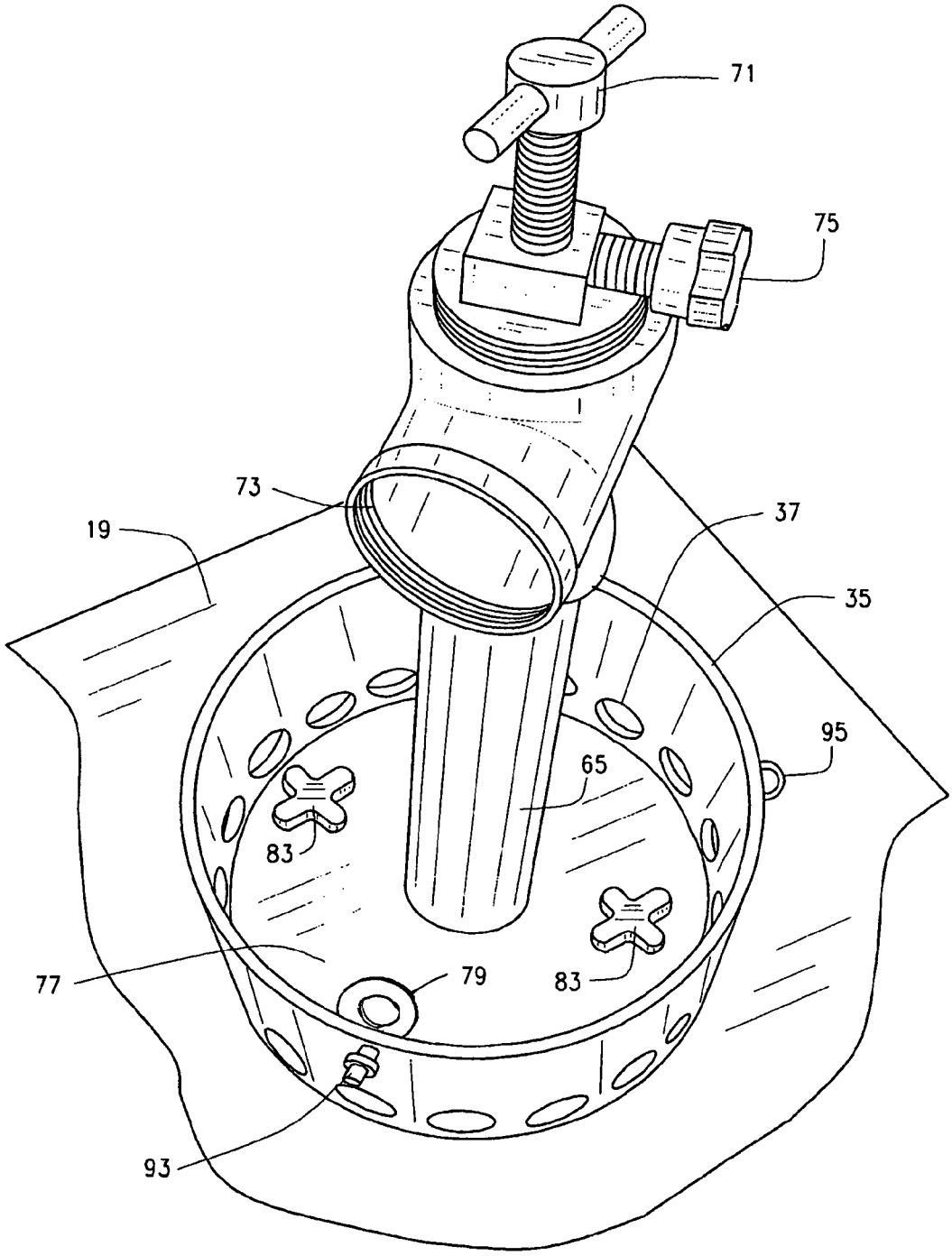
FIG. 3 is a view in perspective of the device of FIG. 1, showing an upper portion of the device of FIG. 1 with a cover removed.
Figure 6:
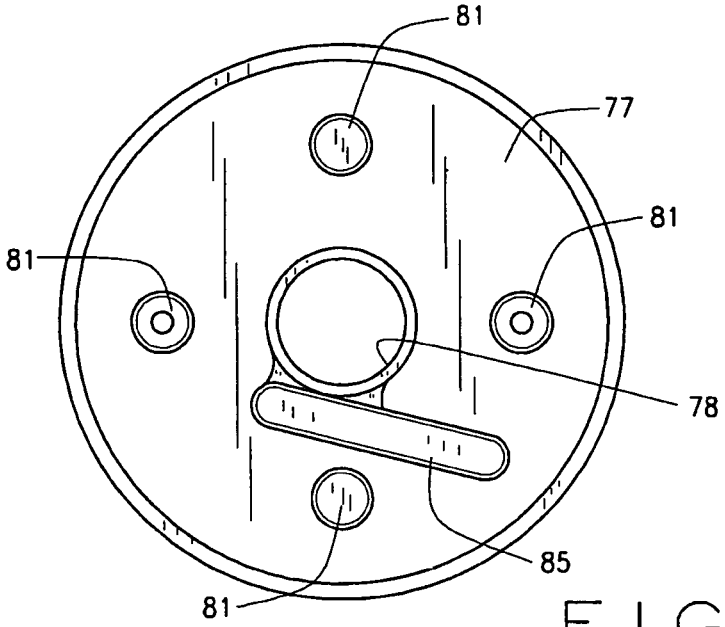
FIG. 6 is a bottom plan view of an upper mounting plate of the device of FIG. 1.

As shown particularly in FIGS. 3 and 6, lift bolts 79 are threaded into two pads 81 of the upper plate, and hand-screws 83 are threaded through openings in two other pads 81 of the upper plate into the tapped holes 29 of the lower mounting plate 21. The hand-screws 83 hold the upper plate 77 to the lower mounting plate 21, thereby locking the o-ring coupler 41 in the inlet adapter 9.

The lower side of the upper plate 77 includes a bracket 85 which carries the controller 55 for the valve 47.

A cover 91 is placed over the diffuser 35, with notches in its lower edge placed over bolts 93 extending out from the diffuser 35 to align the cover. The cover 91 is sized to telescope snugly over the diffuser 35. In this illustrative embodiment, the cover 91 and diffuser 35 are formed from a standard telecommunications equipment enclosure, available from Channell Communications Corporation, Temecula, Calif., as its Budget Pedestal Housing model BPH 1022, having a diameter of about ten inches and an overall height of about twenty-seven inches. This housing is equipped with a standard hasp lock 95 and padlock 97.

Figure 2:
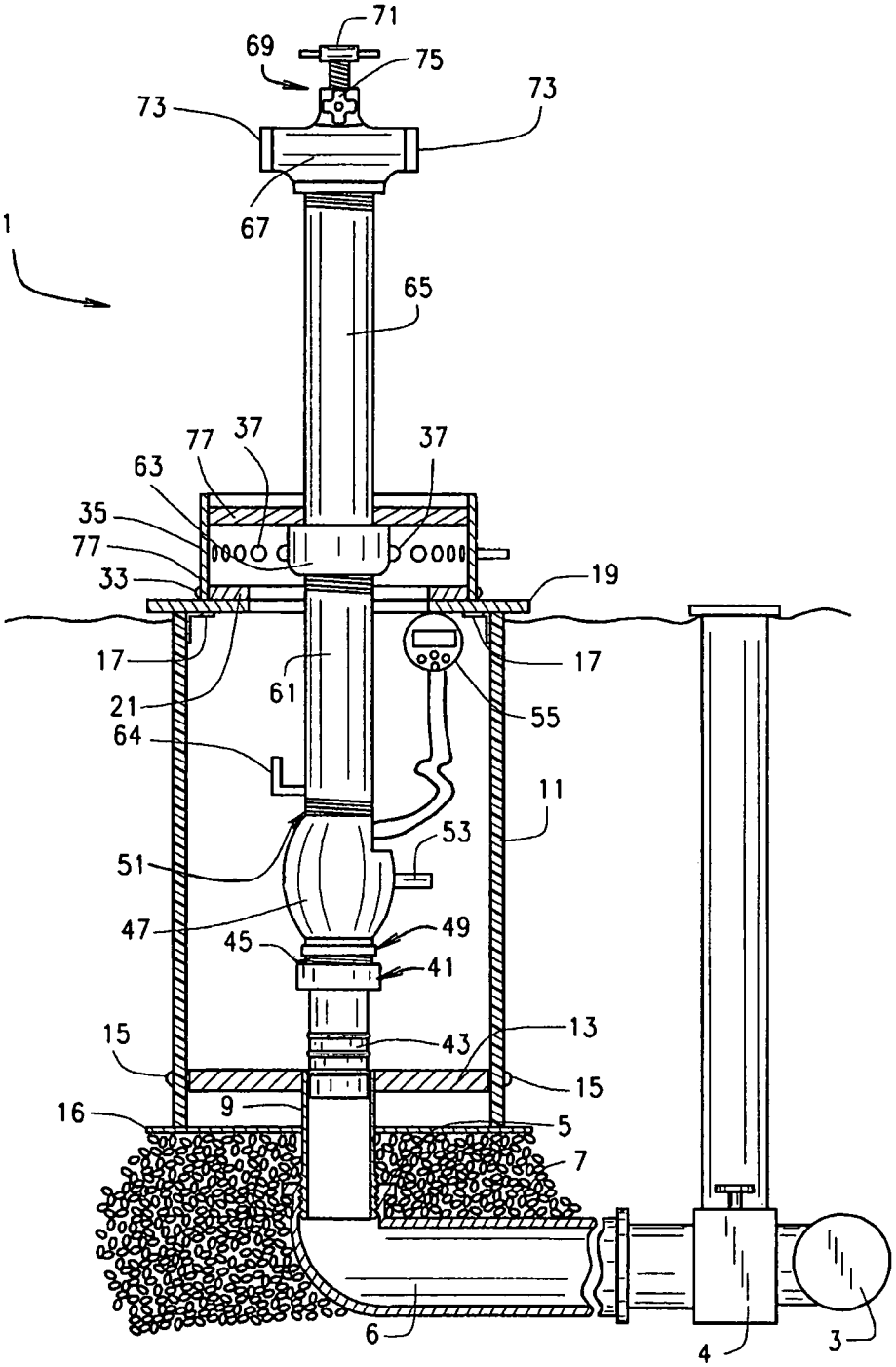
FIG. 2 is a view corresponding to FIG. 1, partially disassembled for service.

When the hand-screws 83 are unscrewed, the top plate can be lifted by the lift bolts 79 to access the controller, without disturbing the rest of the device. As shown in FIG. 2, however, if it is desired to access the valve 47, unscrewing the hand-screws 83 allows lifting the upper outlet pipe 65, thereby pulling the o-ring coupler 41 from the inlet adapter 9 and allowing the entire unit to be pulled up through the openings in the splash guard 19 and the lower mounting plate 21; the pipe coupling 63 will lift the upper plate 77 with it. Controller 55 is either removed or unplugged during removal of the unit.

Figure 7:
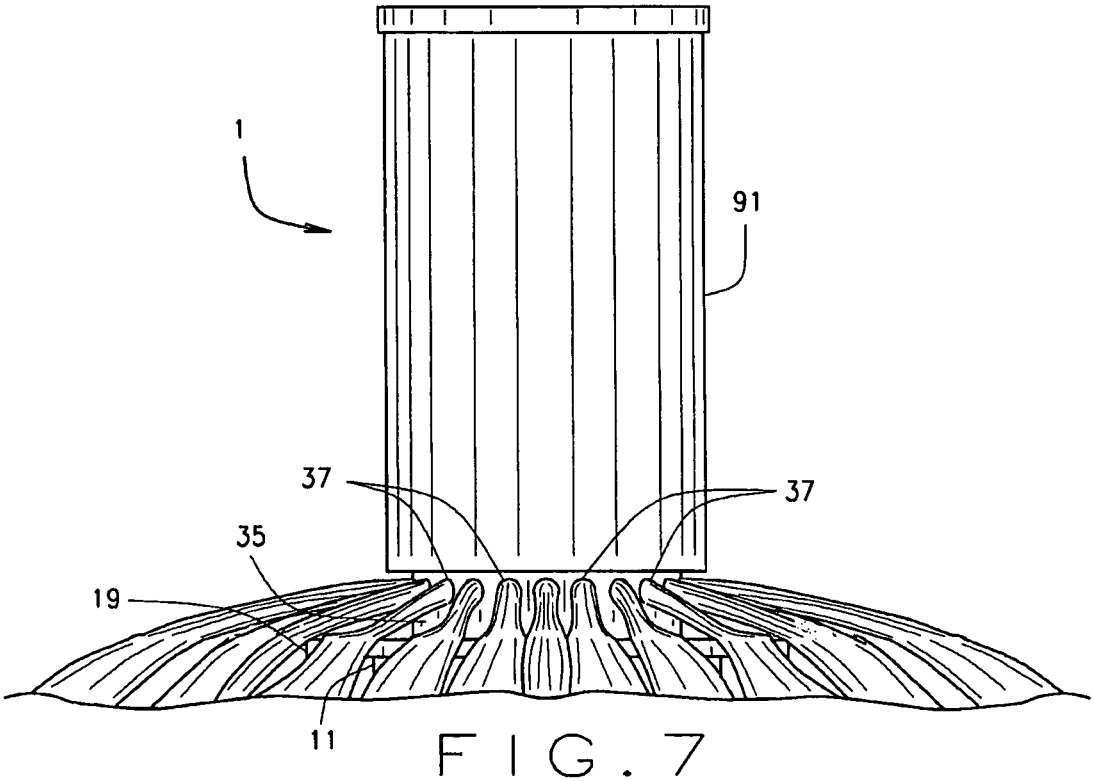
FIG. 7 is a view in side elevation of the device of FIG. 1, with its cover on, flushing water.

The use of the device 1 is simple. The controller 55 is set for the desired interval, the upper plate is slid into place, and the hand-screws 83 are tightened. When the controller 55 opens the valve 47, water flows from the inlet at o-ring coupler 41, through the horizontal arms 73 of the outlet, into contact with the inner vertical wall of the cover 91 from which it rebounds laterally and exits laterally from the circumferential openings 37 with considerable force. Because the water exits laterally in a large circle, rather than discharging directly and forcefully in a small area directly below the device, and because it is discharged intermittently over relatively long intervals, it does not tend to erode the area where it lands. It will be seen that most of the discharged water lands outside the splash pad, whose function is largely in maintaining a clear area around the device 1 and in preventing the creation of a muddy area directly adjacent the device. FIG. 7 illustrates a typical discharge pattern of the illustrative embodiment of the invention.

When the valve 47 closes, the ball check valve 64 is released and discharges the water remaining in the pipes 61 and 65 into the interior of the casing 11, from which it drains through the gravel or dirt 7, thereby protecting the system from freezing.

Figure 8:
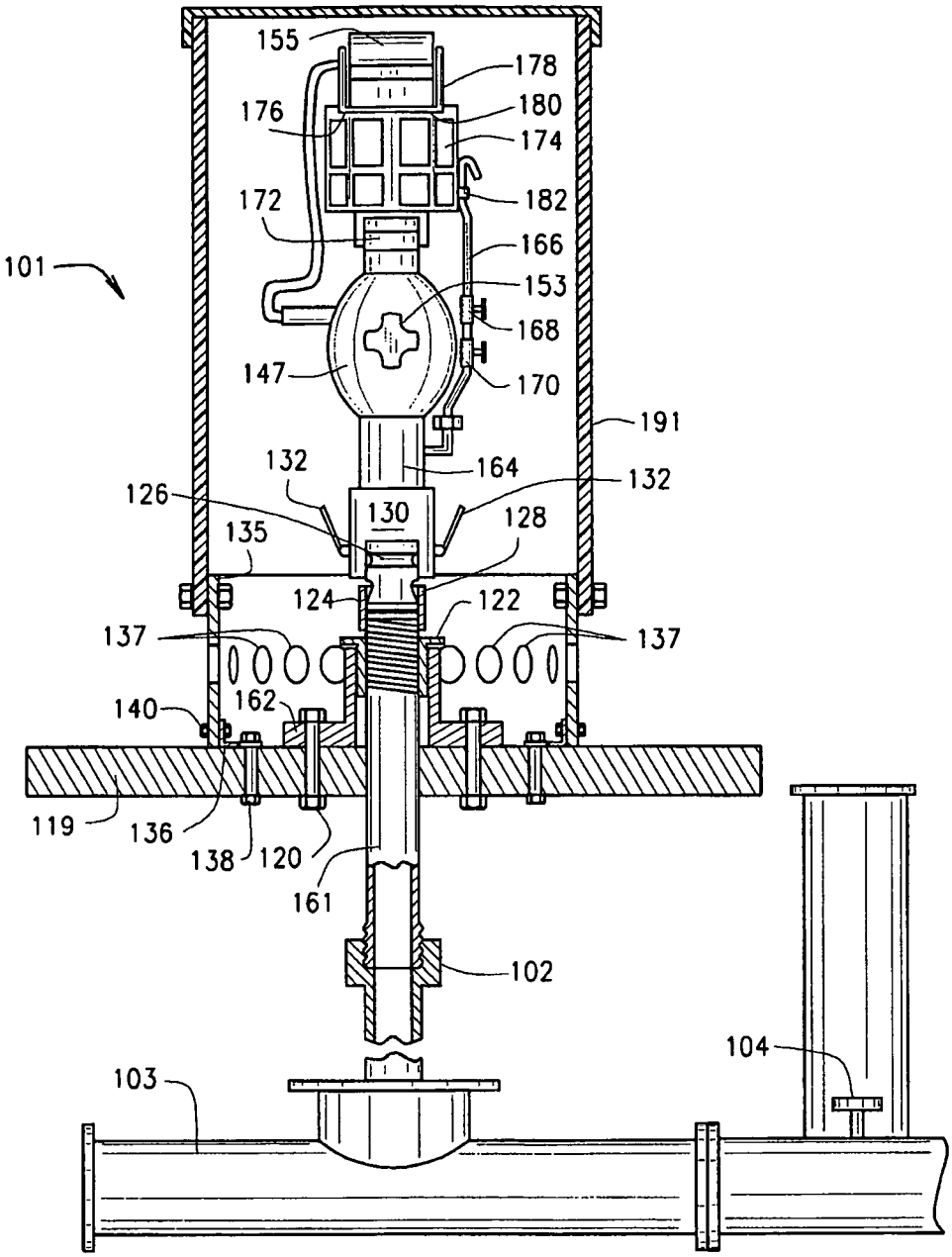
FIG. 8 is a diagrammatic view in partial cross section showing a flushing hydrant in accordance with a second embodiment of the present invention.

In situations in which freezing is not a problem, the device can be modified and simplified. One illustrative embodiment of such a device 101 is shown in FIG. 8. In this device, the valve 147 and controller 155 (which may be the same as valve 47 and controller 55 of the first embodiment) are mounted above ground in an enclosure or housing comprising a diffuser 135 and a cover 191 (which may be the same as diffuser 35 and cover 91 of the first embodiment) on a splash guard 119 corresponding to splash guard 19 of the first embodiment.

In this embodiment, as in the previous embodiment, a separate manual shut-off valve 104 is conventionally provided between an upstream part of the water main and the device 101. Sections of two-inch brass pipe are threaded into the main 103 to a height a few inches below ground level, terminating in a female fitting 102. A two-inch brass pipe 161 is threaded into the fitting 102 and extends through an opening in the splash guard 119. A coupling 162 is bolted to the base 119 as shown at 120. A PVC bushing 122 is threaded into the coupling 162, and an upper, threaded end of the pipe 161 is threaded through the bushing 122, leaving a short threaded end extending above the bushing 122. A two-inch PVC traffic coupling 124 is threaded onto the upper end of the pipe 161 to provide a breakaway. The lower half 126 of a conventional quick-disconnect coupling 128 is threaded into the upper half of the traffic coupling 124. The upper half 130 of the quick-disconnect coupling 128 is held to the lower half by conventional cam handles 132. The valve 147 is attached to the upper half 130 of the quick disconnect coupling 128 by a two-inch brass nipple 164. A sampling tube 166 having a manual sampling valve 168 and a manual shut-off valve 170 is tapped into the nipple 164 to permit sampling independent of the electrically operated valve 147. Above the valve 147, a two-inch brass nipple 172 is threaded into its outlet. A diverter cage 174 is threaded onto the upper end of nipple 172. The diverter cage 174 has a solid top wall 176 against which water from the nipple 172 impinges. The controller 155 is held in a holder 178 on the upper side of the top wall 176 by screws 180. The sampling tube 166 is held by clips 182 to the diverter cage 174 for stability. Because the valve 147 is above ground, its manual flow adjustment knob 153 is easily accessible and the flow adjuster 69 is not required.

The diffuser 135 of this embodiment is held by L-brackets 136, held by bolts 138 to the splash guard 119, by means of bolts 140. The cover 191 is attached in the same way as the cover 91 of the previous embodiment and performs the same functions.

It will be noted that to accommodate the valve 147 in the cover 191 of the housing, the pipe 161 is offset from the center of the diffuser 135.

If desired, a rubber or plastic apron may be wrapped around the nipple 172 to protect any water-sensitive parts below the nipple 172.

The discharge pattern of this illustrative embodiment is similar to that of the first illustrative embodiment.

As various changes could be made in the above constructions without departing from the scope of the invention, it is intended that all matter contained in the above description or shown in the accompanying drawings shall be interpreted as illustrative and not in a limiting sense.

Numerous variations in the flushing device of the present invention will occur to those skilled in the art in view of the foregoing disclosure.

Merely by way of illustration, other enclosures can be utilized, as can other arrangements of outlet apertures or other outlets entirely, such as those described in the aforementioned Newman, U.S. Pat. No. 6,035,704, although this approach is not presently preferred.

The second mount need not be in the form of a lower plate; it can be a different mount, as long as it is a structure (or structures) mounted on or integral with the casing 11 that allows structure (illustratively the upper plate) to be attached to it to hold an inlet coupler to an outlet of a water main, and that allows the main valve to be extracted. The first mount may likewise be structure other than a plate, so long as it is functionally attached to the inlet coupler and can be removably attached to the second mount to hold the inlet coupler in a water-tight seal with the outlet of the water main. If the first mount is not an upper plate, some sort of plate-like structure is preferably provided in the illustrative embodiment, to prevent a large part of the discharge water from falling into the casing 11; in arrangements in which inhibiting water from falling below the first mount is not important, the first mount may be of almost any form. In the illustrative embodiment, a rubber shield may be placed over the upper plate.

The splash guard 19 may be of various sizes and configurations, or eliminated altogether. It may be positioned at any desired height relative to the ground, preferably at or above ground level.

The outlets 37 can be changed to direct the water in any desired direction, and various baffles could be included to direct the water in different directions before it is discharged laterally. It is preferred, but not always essential, for the water to be discharged in a full 360° halo. The flow adjuster 69 may be eliminated and a tee fitting substituted for the cross fitting of the illustrative embodiment.

A feed chemical such as dechlorination tablets may be placed in the water path, or check valves and backflow preventers may be incorporated, as is well known in the art. Different check valves and other freeze-proofing systems, or none, may be used. Sampling piping may be added to allow sampling of water in the main 3 independent of the valve 47.

Other automatically controllable valves and other controls may be utilized, although the preferred solenoid valve and control are particularly simple. As set out in DeLattre et al, U.S. Pat. No. 5,797,417, the control may be powered in various ways, such as a rechargeable battery charged by solar or wind power, and may be controlled in various ways such as infra-red, telephone, or radio communication, either one-directional or bidirectional. As also set out in that patent, condition sensors rather than a timer may be used for controlling the operation of the device; it is therefore to be understood that the "periodic" operation of the valve need not occur on a strict timetable. More complex controls may also be used, as for example those described in Waltzer et al., U.S. Pat. No. 4,799,142, Kendall, U.S. Pat. No. 4,189,776, and Kendall et al., U.S. Pat. No. 4,165,532. The controller 55 can be of any desired construction. If the controller is of the long-known type which can be programmed remotely, removal of the upper plate 77 is less important. Likewise, access to the controller 55 could be through a door or slot in the upper plate 77. Portions of the invention may be used with entirely different systems, such as systems having manually operable valves.

These variations are merely illustrative.

All of the patents and printed publications mentioned herein are hereby incorporated by reference.

The invention claimed is:

1. A system for flushing a portion of an underground municipal water distribution system, the system comprising:

an in-ground enclosure, at least a major portion of the in-ground enclosure being located below ground level;

a flushing device at least partially positioned in the enclosure, the flushing device comprising an underground inlet adapted for receiving pressurized water from the water distribution system through a vertical push-together fitting, the push-together fitting forming a watertight fit through a range of axial positions of a plug part and a plugreceiving part of the push-together fitting, an above-ground outlet in fluid connection with the inlet through a conduit, and an underground control valve between the inlet and outlet, the control valve controlling the flow of pressurized water between the inlet and the outlet, a first mount engaging the flushing device and locating at least a part of the flushing device with respect to the in-ground enclosure, the first mount being operatively releasably mounted to an upper portion of the in-ground enclosure, the system being so constructed and proportioned that (a) when the first mount is mounted to the in-ground enclosure the first mount holds the push-together fitting together and (b) releasing the first mount from the in-ground enclosure allows pulling the push-together fitting apart by sliding in an axial direction and allows lifting and extracting the flushing device, including the inlet, the conduit, and the control valve, from the underground water distribution system entirely from above.

2. The system of claim 1 further comprising a second mount secured to the enclosure, the first mount being releasably mounted to the second mount.

3. The system of claim 2 wherein at least one of the first mount and the second mount is a plate.

4. The system of claim 1 wherein the enclosure comprises a plastic pipe.

5. The system of claim 1 wherein the outlet expels water outwardly.

6. A system for flushing a portion of an underground municipal water distribution system, the system comprising:

an in-ground enclosure, at least a major portion of the in-ground enclosure being located below ground level;

a flushing device at least partially positioned in the enclosure, the flushing device comprising an underground inlet adapted for receiving pressurized water from the water distribution system through a vertical push-together fitting, the push-together fitting forming a watertight fit through a range of axial positions of a plug part and a plugreceiving part of the push-together fitting, an above-ground outlet in fluid connection with the inlet through a conduit, the outlet expelling water outwardly, and an underground control valve between the inlet and outlet, the control valve controlling the flow of pressurized water between the inlet and the outlet, a first mount locating at least a part of the flushing device with respect to the inground enclosure, the first mount being operatively releasably mounted to an upper portion of the in-ground enclosure, the system being so constructed and proportioned that releasing the first mount from the in-ground enclosure allows pulling the push-together fitting apart by sliding in an axial direction and allows lifting the flushing device, including the inlet, the conduit, and the control valve, from the underground water distribution system entirely from above, the outlet being surrounded by a housing, the housing redirecting the water discharged from the outlet outwardly to ambient.

7. The system of claim 6 wherein the housing comprises a diffuser having a plurality of openings arranged circumferentially around the housing, and a removable cover extending above the diffuser.

8. The system of claim 7 wherein the first mount comprises a plate.

9. The system of claim 1 wherein the device further comprises a second mount fixed with respect to the enclosure, the first mount being removably connected to the second mount.

10. A flushing system for flushing a portion of an underground municipal water distribution system, the flushing system comprising:

an in-ground enclosure;

a flushing device at least partially positioned in the enclosure, the flushing device comprising an inlet adapted for receiving pressurized water from the water distribution system through a push-together fitting, an outlet in fluid connection with the inlet, and a control valve between the inlet and outlet, the control valve controlling the flow of pressurized water between the inlet and the outlet, a bracket engaging a lower part of the push-together fitting and the in-ground enclosure to hold and position the lower part of the push-together fitting below ground in relation to the in-ground enclosure, an enlargement on the flushing device between the inlet and the outlet, and a first mount engaging the enlargement on the flushing device and locating an upper portion of the flushing device with respect to the in-ground enclosure, the first mount being operatively releasably mounted to the upper portion of the in-ground enclosure, the system being so constructed and proportioned that (a) when the first mount is mounted to the in-ground enclosure the first mount holds an upper part and the lower part of the push-together fitting together and (b) releasing the first mount from the in-ground enclosure allows pulling the push-together fitting apart by sliding in an axial direction and allows lifting and extracting the flushing device, including the upper part of the push-together fitting, the conduit, and the control valve, from the underground water distribution system entirely from above.

11. The flushing system of claim 10 wherein the push-together fitting includes a male part and a female part, at least one of the male part and female part including a plurality of o-rings.

12. The flushing system of claim 10 further comprising an intermediate mount secured to the enclosure, the first mount being releasably mounted to the intermediate mount.

13. The flushing system of claim 10 further comprising an above-ground housing, the housing comprising a removable cover surrounding the outlet and extending above and below the outlet when the first mount is mounted to the upper portion of the enclosure.

14. A flushing system for flushing a portion of an underground municipal water distribution system, the flushing system comprising:

an in-ground enclosure;

a flushing device at least partially positioned in the enclosure, the flushing device comprising an inlet adapted for receiving pressurized water from the water distribution system through a push-together fitting, an outlet in fluid connection with the inlet, and an underground electrically controlled valve between the inlet and outlet, the electrically controlled valve controlling the flow of pressurized water between the inlet and the outlet, and an upper mount engaging the flushing device and locating at least the inlet with respect to the enclosure, a positive attachment operatively releasably mounting the upper mount to an upper portion of the enclosure and holding the push-together fitting together, the flushing system being so constructed and arranged that releasing the upper mount from the enclosure allows extracting and disconnecting the flushing device from the underground water distribution system entirely from above.

15. The flushing system of claim 14 further comprising an above-ground housing, the housing comprising a removable cover surrounding the outlet and extending above and below the outlet when the upper mount is mounted to the upper portion of the enclosure.

16. The flushing system of claim 14 further comprising a lower bracket operatively engaging the enclosure and aligning the enclosure with respect to a lower part of the push-together fitting to align the flushing device with respect to the enclosure.

17. A device for automatically flushing a portion of an underground municipal water distribution system, the device comprising:

a generally vertical pipe having an underground inlet for receiving pressurized water from the water distribution system and an above-ground outlet fluidly connected to the inlet for discharging pressurized water received from the inlet, an automatic control valve for controlling the flow of pressurized water between the inlet and the outlet, a base mounted on the ground, and a housing, the housing redirecting the water discharged from the outlet laterally to ambient away from the exterior of the housing, the housing comprising:

(i) a diffuser mounted to the base, the diffuser having a generally cylindrical peripheral external vertical wall with a plurality of discharge openings in the vertical wall, the vertical wall completely encircling a length of the generally vertical pipe below the outlet, and (ii) a generally cylindrical removable cover removably mounted to the vertical wall of the diffuser above the discharge openings, the removable cover being spaced above the base by the diffuser, the removable cover comprising a generally vertical wall encircling the outlet of the generally vertical pipe and extending above the outlet, the vertical wall being generally coaxial with the diffuser, and an upper wall extending across an upper end of the generally vertical wall and over an upper end of the generally vertical pipe, said housing being constructed to redirect said pressurized water and to disperse water laterally away from the exterior of the housing through the discharge openings in the diffuser.

18. The device of claim 17 wherein the base extends outwardly and forms a splash guard below the openings.

19. The device of claim 17 wherein the outlet discharges water outwardly in a plurality of directions.

20. The device of claim 17 wherein the housing discharges water generally laterally radially outward in a circle.

21. The device of claim 20 wherein the housing is made of plastic and has a diameter of from about eight to about fifteen inches.

22. The device of claim 17 wherein water from the outlet is directed against the cover of the housing.

23. The device of claim 18 wherein the inlet of the pipe comprises one half of a push-together fitting including a male part and a female part, at least one of the male part and female part of the fitting including a plurality of o-rings.

24. The device of claim 23 including a lock that releasably locks the male and female parts together.

25. The device of claim 17 wherein the cover is telescoped snugly over the diffuser.

* * * * *